US011692353B2

(12) United States Patent
Folkersen et al.

(10) Patent No.: US 11,692,353 B2
(45) Date of Patent: Jul. 4, 2023

(54) DOUBLE COVERAGE ROOF WALL FLASHING WITH CAVITY

(71) Applicant: Roofers' Advantage Products, LLC, E. Wakefield, NH (US)

(72) Inventors: Jonny E. Folkersen, East Wakefield, NH (US); Benjamin J. Folkersen, East Wakefield, NH (US)

(73) Assignee: Roofer's Advantage Products, LLC, E. Wakefield, NH (US)

( * ) Notice: Subject to any disclaimer, the term of this patent is extended or adjusted under 35 U.S.C. 154(b) by 95 days.

(21) Appl. No.: 16/995,318

(22) Filed: Aug. 17, 2020

(65) Prior Publication Data

US 2020/0378127 A1 Dec. 3, 2020

Related U.S. Application Data

(63) Continuation-in-part of application No. 16/355,270, filed on Mar. 15, 2019, now Pat. No. 10,774,537.

(60) Provisional application No. 62/659,757, filed on Apr. 19, 2018, provisional application No. 62/643,335, filed on Mar. 15, 2018.

(51) Int. Cl.

| | |
|---|---|
| ***E04D 13/04*** | (2006.01) |
| ***E04D 13/15*** | (2006.01) |
| *E04D 13/155* | (2006.01) |

(52) U.S. Cl.

CPC ..... *E04D 13/0459* (2013.01); *E04D 13/15* (2013.01); *E04D 13/155* (2013.01); *E04D 2013/0468* (2013.01)

(58) Field of Classification Search

CPC ..... E04D 13/15; E04D 13/155; E04D 13/14; E04D 13/0459; E04D 12/15

See application file for complete search history.

(56) References Cited

U.S. PATENT DOCUMENTS

| | | | | |
|---|---|---|---|---|
| 1,685,525 A | | 9/1928 | Dow | |
| 1,860,240 A | | 5/1932 | Friedrich | |
| 2,121,372 A | * | 6/1938 | Tucker | E04D 13/1415 52/62 |
| 3,243,926 A | | 4/1966 | Keyt | |

(Continued)

OTHER PUBLICATIONS

Office Action for U.S. Appl. No. 17/073,710 dated Sep. 10, 2021, 15 Pages.

(Continued)

*Primary Examiner* — Paola Agudelo

(74) *Attorney, Agent, or Firm* — Maine Cernota & Rardin

(57) ABSTRACT

A drip edge having a flange configured to rest against a roof surface following installation on a perimeter of the roof surface and a flap hingedly extending from a terminal edge of the flange configured to be positioned a predefined distance towards the center of the roof surface, as measured from an edge of the roof surface on which the flange is configured to be mounted, following installation of the flange on the roof surface, wherein the flap and flange, in combination, form a cavity configured to retain a shingle therein, thereby improving the strength with which the starter shingle is secured to the roof surface against wind uplift while improving its resilience to moisture intrusion and easing installation while also rendering shingle alignment more consistent.

25 Claims, 13 Drawing Sheets

(56) References Cited

U.S. PATENT DOCUMENTS 3,405,485 A * 10/1968 Edwards ..... E04D 13/15 52/60
3,415,020 A * 12/1968 Windle ..... E04D 13/15 52/716.2
3,436,877 A 6/1969 Gunning
4,071,987 A * 2/1978 Hickman ..... E04D 13/155 52/60
4,155,203 A * 5/1979 Wolma ..... E04D 13/15 52/60
4,254,594 A 3/1981 Hammond
4,332,117 A 6/1982 Quinnell
4,472,913 A * 9/1984 Hickman ..... E04D 13/155 52/717.06
4,594,820 A 6/1986 Render
4,665,667 A 5/1987 Taylor
4,780,997 A 11/1988 Taylor
4,780,999 A * 11/1988 Webb ..... E04D 13/155 52/60
4,848,045 A 7/1989 Nichols
4,864,781 A * 9/1989 Emblin ..... E04D 13/1606 52/404.3
4,951,431 A * 8/1990 Sweers ..... E04D 13/1475 52/60
4,964,248 A * 10/1990 Braine ..... E04D 3/405 52/60
5,065,553 A * 11/1991 Magid ..... E04D 13/1407 52/60
5,109,641 A 5/1992 Halan
5,170,597 A 12/1992 Steams
D342,326 S * 12/1993 Hansson ..... D25/138
5,328,406 A * 7/1994 Morris, Jr. ..... E04D 13/178 52/95
5,337,526 A 8/1994 Hartman
D354,733 S 1/1995 Ingraham
5,392,579 A 2/1995 Champagne
D359,368 S 6/1995 Anderson
5,522,189 A 6/1996 Mortensen
5,586,414 A 12/1996 Tawzer
D397,810 S * 9/1998 Basset ..... D25/199
5,941,028 A * 8/1999 Hicks ..... E04D 13/152 52/95
D422,095 S 3/2000 Thagard, III
6,035,587 A * 3/2000 Dressler ..... E04D 13/0459 52/716.2
6,186,605 B1 2/2001 Nelson
D438,650 S 3/2001 Neuhofer, Jr.
6,273,385 B1 8/2001 Hambleton
D452,918 S 1/2002 Ohanesian
6,715,237 B2 4/2004 Batt, Sr.
6,780,099 B1 8/2004 Harper
6,848,220 B2 2/2005 Faurholdt
6,880,302 B1 4/2005 Fontaine
D569,011 S 5/2008 Brochu
7,451,572 B1 11/2008 Inzeo
7,546,719 B1 6/2009 Guevara
7,735,267 B1 * 6/2010 Ayers, Jr. ..... E04D 13/15 52/60
7,941,989 B2 * 5/2011 Morsching ..... E04D 13/15 52/92.1
8,281,521 B1 10/2012 Rasmussen et al.
8,316,587 B2 * 11/2012 Shugart ..... E04D 13/158 52/95
D700,717 S 3/2014 Campacci
8,739,470 B1 * 6/2014 Wayne ..... E04D 13/15 52/96
D711,556 S 8/2014 Singh
8,869,466 B2 10/2014 Garcia
D742,546 S 11/2015 Singh
9,200,450 B2 12/2015 Thagard, III
D750,806 S 3/2016 Singh
9,394,693 B2 7/2016 Daniels
9,650,787 B2 5/2017 Montojo
D805,215 S 12/2017 Fowler
10,000,930 B2 6/2018 Lowe
10,036,166 B1 7/2018 Heo
D829,928 S 10/2018 Dye
10,100,530 B1 * 10/2018 Clark ..... E04F 13/0864
10,125,497 B2 11/2018 Givens
D844,182 S * 3/2019 Folkersen ..... D25/199
D861,196 S 9/2019 Apanovich
D882,125 S 4/2020 Divito
2002/0178671 A1 * 12/2002 Gembala ..... E04D 13/0459 52/302.6
2003/0121217 A1 * 7/2003 Grizenko ..... E04D 13/158 52/287.1
2004/0016201 A1 1/2004 Folkersen
2004/0103592 A1 * 6/2004 Edvardsen ..... E04D 13/1475 52/58
2005/0005551 A1 1/2005 Graham
2005/0086873 A1 * 4/2005 Mares ..... E04D 13/1478 52/58
2006/0016130 A1 1/2006 Lin
2006/0075694 A1 * 4/2006 Lin ..... E04D 13/178 52/94
2006/0254169 A1 11/2006 McFadden
2007/0074466 A1 4/2007 Rasmussen
2007/0107320 A1 * 5/2007 Brochu ..... E04D 13/152 52/22
2007/0266657 A1 * 11/2007 Gembala ..... E04D 13/15 52/288.1
2008/0005975 A1 * 1/2008 Thompson ..... E04B 1/003 52/62
2009/0229209 A1 * 9/2009 Crego ..... E04D 3/366 52/462
2010/0300011 A1 * 12/2010 Crego ..... E04D 13/151 52/60
2011/0049118 A1 3/2011 Nark
2011/0185665 A1 8/2011 Allen
2012/0102849 A1 5/2012 Shugart
2016/0376791 A1 * 12/2016 Givens ..... E04D 13/1478 52/62
2017/0226741 A1 * 8/2017 Givens ..... E04D 13/0459
2018/0066436 A1 * 3/2018 Stiglmayr ..... E04D 13/0459
2018/0223537 A1 * 8/2018 Bredeweg ..... E04D 13/158
2018/0266115 A1 9/2018 Dye
2018/0347197 A1 * 12/2018 Folkersen ..... E04D 13/158
2019/0284810 A1 9/2019 Folkersen
2019/0284814 A1 9/2019 Folkersen

OTHER PUBLICATIONS

Notice of Allowance for Design U.S. Appl. No. 29/683,781, dated Aug. 26, 2020, 27 Pages.
Notice of Allowance for U.S. Appl. No. 16/355,358, dated Sep. 15, 2020, 11 Pages.

* cited by examiner

DOUBLE COVERAGE ROOF WALL FLASHING WITH CAVITY

RELATED APPLICATIONS

This application is a Continuation In Part of U.S. application Ser. No. 16/355,270, filed Mar. 15, 2019, which claims the benefit of U.S. Provisional Applications Nos. 65/659,757, filed Apr. 19, 2018, and 60/643,335, filed Mar. 15, 2018. Each of these applications is herein incorporated by reference, in its entirety, for all purposes.

FIELD OF THE INVENTION

The invention relates roofing, and, more particularly, to flashing and drip edges used in roof applications.

BACKGROUND OF THE INVENTION

It is commonplace to install metal flashing where a wall intersects the roof plane and at edges of a roof and metal drip edges adjacent the eaves and rakes of a roof. In sloped roofing applications, it is typical for the roof to encounter a wall, such as a dormer. In flat roof installations, many roof systems terminate at a parapet, roof protrusion, or wall.

The roofing industry has typically frowned on second layer roof applications, due to the inability of the next cover roofing system to tie into existing flashing or drip edges when encountering a wall or eave/rake, respectively. The problem is further exacerbated when a cover material, such as stucco, siding, or other cover, extends over the top edge of the existing flashing or drip edge. To replace the existing flashing or drip edge, the cover material needs to be removed and reinstalled or replaced. These steps add time and expense to roof replacement.

Despite the roofing industry's reservations regarding second layer roofing applications, the use and encouragement of second layer roof applications remains desirable, primarily due to cost and environmental impact benefits. Moreover, there is a substantial movement towards shingle recycling and keeping the existing shingles on the roof through another roofing cycle, as more communities come on board with shingle recycling efforts. Suffice it to say that, second layer applications are cleaner, while saving the owner money and the roofing contractor time.

Regarding flashing installed at the edges of a roof (i.e. drip edges), such flashing is often subjected to high wind that can result in shingle removal or damage and also is subject to damage, such as nail blow-through during installation, especially where installation is performed in cold weather.

What is needed, therefore, is flashing that can be used in second layer roofing applications that is able to tie into existing flashings when encountering a wall, without removal and/or replacement of the existing flashing and flashing for use at the edges of a roof that can improve the resilience of shingles mounted thereon to wind uplift and moisture intrusion while lessening the chances of damage thereto during cold weather installation.

SUMMARY OF THE INVENTION

A roof wall flashing comprising a cavity suitable for second layer recoverability that is built into the flashing itself allows for tying into existing flashing when encountering a wall without removal and/or replacement of existing flashing.

Drip edges that provide a cavity allow a shingle to be securely and easily fastened to a building envelope by better spreading the load of the fasteners across the shingle, both increasing their resistance to wind uplift and nail blow through.

In one embodiment of the present disclosure provides a drip edge comprising a flange configured to rest against a roof surface following installation on a perimeter of the roof surface; and a flap hingedly extending from a terminal edge of the flange configured to be positioned a predefined distance towards the center of the roof surface, as measured from an edge of the roof surface on which the flange is configured to be mounted, following installation of the flange on the roof surface, wherein the flap and the flange, in combination, form a cavity configured to retain a shingle therein.

Another embodiment of the present disclosure provides such a drip edge, the drip edge further comprising a kick extending downwards from a terminal edge of the flange opposite the terminal edge of the flange on which the flap extends from, the terminal edge of the flange opposite the terminal edge of the flange on which the flap extends from being configured to be adjacent the edge of the roof surface on which the flange is configured to be mounted after installation on the roof, wherein the kick 312 is configured to abut a wall and direct moisture away from the wall following installation of the flange on the building envelope.

A further embodiment of the present disclosure provides such a drip edge, wherein the drip edge further comprises at least one protrusion in the flange.

Yet another embodiment of the present disclosure provides such a drip edge, wherein the at least one protrusion in the flange comprises a stiffening feature.

A yet further embodiment of the present disclosure provides such a drip edge, wherein the stiffening feature comprises at least one rib Still another embodiment of the present disclosure provides such a drip edge, further comprising at least one protrusion in the flap hingedly extending from a terminal edge of the flange.

A still further embodiment of the present disclosure provides such a drip edge, wherein each of the at least one protrusion in the flap hingedly extending from a terminal edge of the flange is parallel to each of the at least one protrusion in the flange.

Even another embodiment of the present disclosure provides such a drip edge, wherein the drip edge further comprises at least one protrusion or recess in the flange.

An even further embodiment of the present disclosure provides such a drip edge, wherein the drip edge further comprises at least one protrusion or recess in the flap hingedly extending from a terminal edge of the flange.

A still even another embodiment of the present disclosure provides such a drip edge, further comprising at least one protrusion or recess in the flange.

A still even further embodiment of the present disclosure provides such a drip edge, wherein at least one protrusion or recess in the flange is aligned with at least one recess or protrusion, respectively in the flap hingedly extending from a terminal edge of the flange.

Still yet another embodiment of the present disclosure provides such a drip edge, wherein a terminal edge of the flap hingedly extending from a terminal edge of the flange is configured to align with a terminal edge of the flange parallel to and opposite from the terminal edge of the flange on which the flap extends from.

A still yet further embodiment of the present disclosure provides such a drip edge, wherein a terminal edge of the flap hingedly extending from a terminal edge of the flange is configured to align with a portion of the flange short of a terminal edge of the flange parallel to and opposite from the terminal edge of the flange on which the flap extends from.

Even yet another embodiment of the present disclosure provides such a drip edge, wherein a terminal edge of the flap hingedly extending from a terminal edge of the flange is configured to retain a starter shingle retained in the cavity configured to retain the starter shingle such that at least a portion of a topside thereof is unobstructed, allowing a portion thereof to adhere to a shingle in an overlying course of shingles.

An even yet further embodiment of the present disclosure provides such a drip edge, wherein a terminal edge of the flange parallel to and opposite from the terminal edge of the flange on which the flap extends from comprises a rounded nose configured to extend off of the roof, following installation thereon.

Still even yet another embodiment of the present disclosure provides such a drip edge, wherein a terminal edge of the flange parallel to and opposite from the terminal edge of the flange on which the flap extends from comprises a 90 degree corner configured to abut a fascia or rake following installation on the roof.

A still even yet further embodiment of the present disclosure provides such a drip edge, wherein a terminal edge of the flap hingedly extending from a terminal edge of the flange that is opposite from and parallel to the terminal edge of the flange from which the flap extends comprises a closed hem.

Yet still even another embodiment of the present disclosure provides such a drip edge, wherein an upper face of the flap hingedly extending from a terminal edge of the flange in configured to be expandable by an installer.

A yet still even further embodiment of the present disclosure provides such a drip edge, wherein the upper face of the flap hingedly extending from a terminal edge of the flange comprises a plurality of lacerations therein configured to allow the expansion thereof.

A yet still even another further embodiment of the present disclosure provides such a drip edge, wherein the intersection of a terminal edge of the flange with a terminal edge of the flange from which the flap extends comprises a closed hem.

Another embodiment of the present disclosure provides such a drip edge, wherein the flap hingedly extending from the terminal edge of the flange comprises a plurality of apertures therethrough.

A further embodiment of the present disclosure provides such a drip edge, wherein the plurality of apertures are dispersed both horizontally and longitudinally across the flap hingedly extending from the terminal edge of the flange.

Yet another embodiment of the present disclosure provides such a drip edge, wherein the plurality of apertures are dispersed longitudinally across the flap hingedly extending from the terminal edge of the flange and wherein the plurality of apertures are configured to indicate predefined nailing locations for fastening a shingle to the drip edge using nails.

A yet further embodiment of the present disclosure provides such a drip edge, wherein the drip edge is made of a material selected from the group consisting of aluminum, steel, copper, and plastics.

Still another embodiment of the present disclosure provides such a drip edge, wherein an edge of the intersection of the flap with the terminal edge of the flange from which the flap extends comprises a notch configured to allow multiple drip edges to be interlocked together.

DETAILED DESCRIPTION

Figure 1:
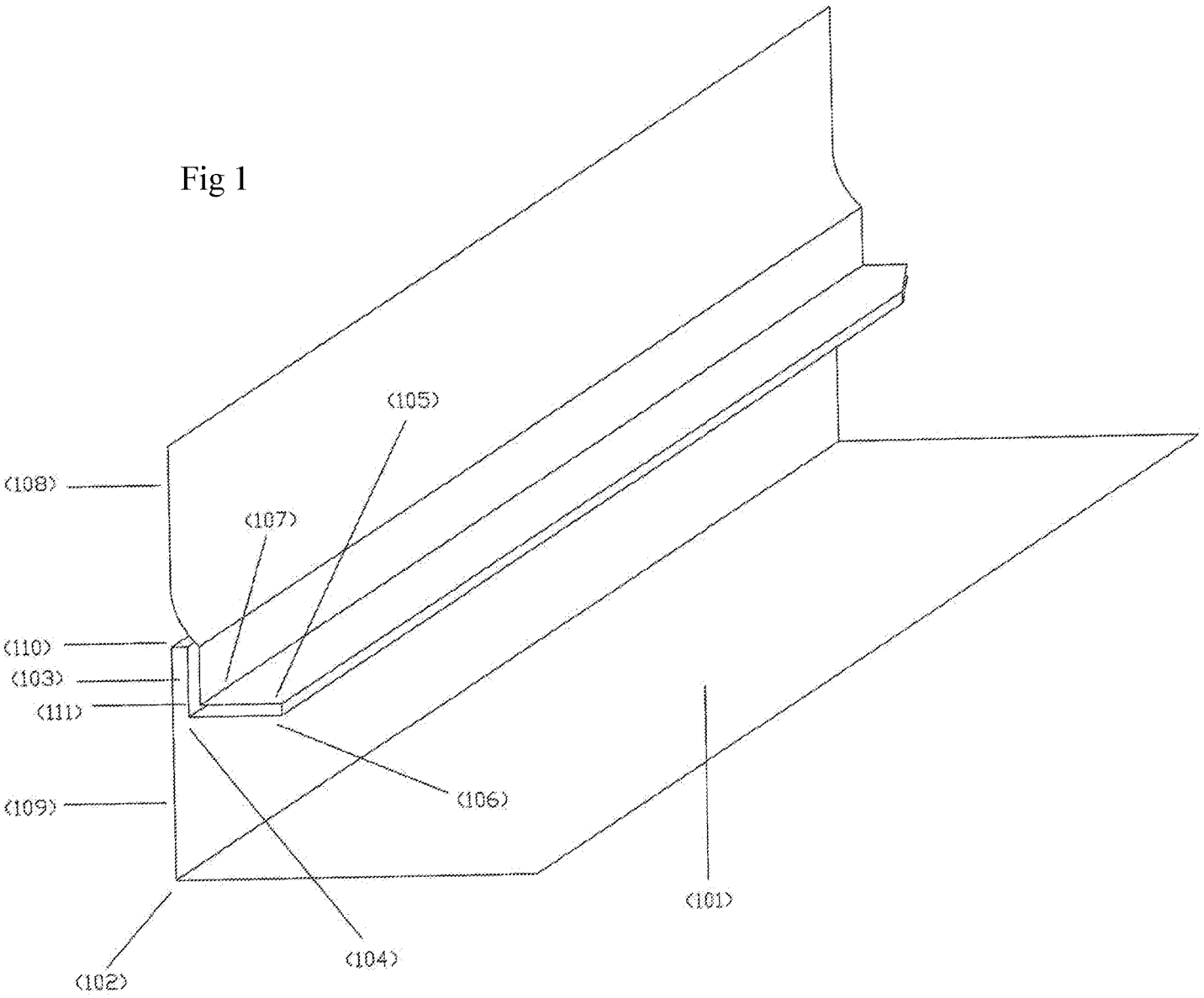
FIG. 1 is a double coverage roof wall flashing comprising a cavity and ledge, in accordance with the embodiments of the present invention.

One embodiment of the present invention, as shown in FIG. 1, provides a base flashing 101 designed to sit on a roof surface and wall flashing 109 and upper wall flashing 108 designed to abut a wall the intersects the plane of a roof. In the case of the roof surface and wall to be flashed being perpendicular to one another, the interior angle 102 created between the base flashing 101 and wall flashing 109 is approximately 90 degrees. Otherwise the base flashing 101 and wall flashing 109 may be bent to match the angle created by the roof and wall to be flashed.

In embodiments, the wall flashing 109 is designed to extend up a vertical wall before returning onto itself, forming a living hinge 110 while also creating a cavity 103. The inner portion of the hinge 111 is further bent approximately 90 degrees 104 away from the wall flashing 109, resulting in it extending away from the wall flashing 109 perpendicularly, before being folded back on itself, resulting in a closed hem 106 that forms a ledge 105. The material forming the ledge 105 is then further bent upwards at approximately a 90 degree angle 107 and, after extending upwards until it is substantially level with the top portion of wall flashing 109, is angled slightly rearwards until it meets the plane defined by the wall flashing 109 and is subsequently angled once again to remain substantially within the plane defined by the wall flashing 109, forming upper wall flashing.

The ledge 105 created by the closed hem 106 may, in embodiments, be biased towards the wall through a spring effect or hinge, which can be created by virtue of the flashing's construction, through the use of special materials and/or alloys, and in other ways, as would be known to those of ordinary skill in the art.

In embodiments, the ledge 105 may be formed above or below a topmost portion of the wall flashing 109. The ledge 105 may also be bent further from the roof plane than 90 degrees, depending on the siding being installed, so as to further compress the cavity 103, due to the weight of the siding material installed. In addition, the ledge 105 may be designed such that the weight of the siding causes it to become parallel to the roof surface following installation. The ledge 105 may also be bent closer to the roof plane to provide for water discharge off of the ledge.

The installation of siding, stucco or the other exterior wall products onto the ledge allows the hinge 110 of the flashing to act like a spring by compressing the cavity 103 thereby further securing flashings installed at the interface between the wall flashing 109 and the inner portion of the hinge 111, which form the cavity 103.

In another embodiment of the present invention, the ledge is eliminated, but the cavity 201 remains and is built into the flashing itself, allowing for second layer recoverability. In this embodiment, the base flashing 202 extends onto the roof surface and is bent at a 90 degree angle 203, becoming wall flashing 204. In other embodiments, the base flashing 202 and wall flashing 204 may be bent to match the angle created by the roof and wall to be flashed. The wall flashing 204 then extends upwards, in use along a vertical wall, before doubling back onto itself, towards the base flashing 202, creating a hinge 209 and a cavity 201. At a certain point, the inner portion of the hinge, which could also be construed as the outer portion of the cavity, again doubles back onto itself, forming a vertically-oriented closed hem 205 that is substantially parallel to the wall flashing 204. Regarding the material forming the closed hem 205, after extending upwards until it is substantially level with a top portion of wall flashing 204, it is then angled slightly rearwards until it meets the plane defined by the wall flashing 204 and is subsequently angled once again to remain substantially within the plane by the wall flashing 109, forming upper wall flashing 207.

In embodiments, the point 206 of the closed hem 205 creates a continuous straight line 208 that siding materials can follow, proving for a clean, finished siding starting point and edge.

The cavity of embodiments (e.g. 103 and 201) provides protection to the top edge of future flashings. For example, after completion of a second layer roof, the closed hem 205 of the embodiment shown in FIG. 2 may be fastened to a wall, securing second layer flashing installed during a roofing repair or re-roofing process.

In embodiments, the flashing is tapered step flashing that accounts for the width of the shingles to be used, thereby maintaining a straight profile of the ledge 105, closed hem 106, the point 206, and the cavity (103 and 201). The flashing with a cavity (103 and 201) may be fabricated to any length that may be needed or required by local building codes.

For sloped roof applications, the step flashing with cavity or continuous flashing with cavity should be installed commencing towards the eave and working towards the ridge for proper overlap and watershed. On flat roof applications, the starting location of the installation of the flashing is not generally important, however, on flat roof applications, a sealant should be installed at the overlap of the wall flashing (204 and 207) sections and the sections may be secured to the wall through the closed hem 205.

In embodiments, the double coverage flashing is installed along a wall during an initial roofing process. While the benefit of the cavity (103 and 201) may not be apparent during the initial roofing, it will become evident when the roof needs to be replaced or serviced. More specifically, if repair or retrofitting of an existing roofing system constructed in accordance with such embodiments is required, it now becomes possible, without removing existing wall cover material and roofing.

Additionally, a roofing underlayment may be installed along the roof surface and up the vertical incline, followed by the disclosed double coverage flashing. At such a time when a second layer roof is installed, step flashing or wall flashing may then be inserted into the cavity (103 and 201).

Furthermore, the joining of one section of flashing to the next using a notch (e.g. 1000) is important to ensure a continuous cavity is formed therebetween. To achieve such fitment, the closed hem (106 and 205) of embodiments may be notched when joining one section to the next. More specifically, the closed hem (106 and 205) disclosed herein may be notched to provide for a seamless look, metal overlap, and to expose the cavity (103 and 206) without interference of an overlap, which would prevent any subsequent flashing from being installed seamlessly.

In embodiments, the notch 1000 is made on-site using tin snips, while, in other embodiments, the notch 1000 may be formed during the manufacturing process.

Figure 2:
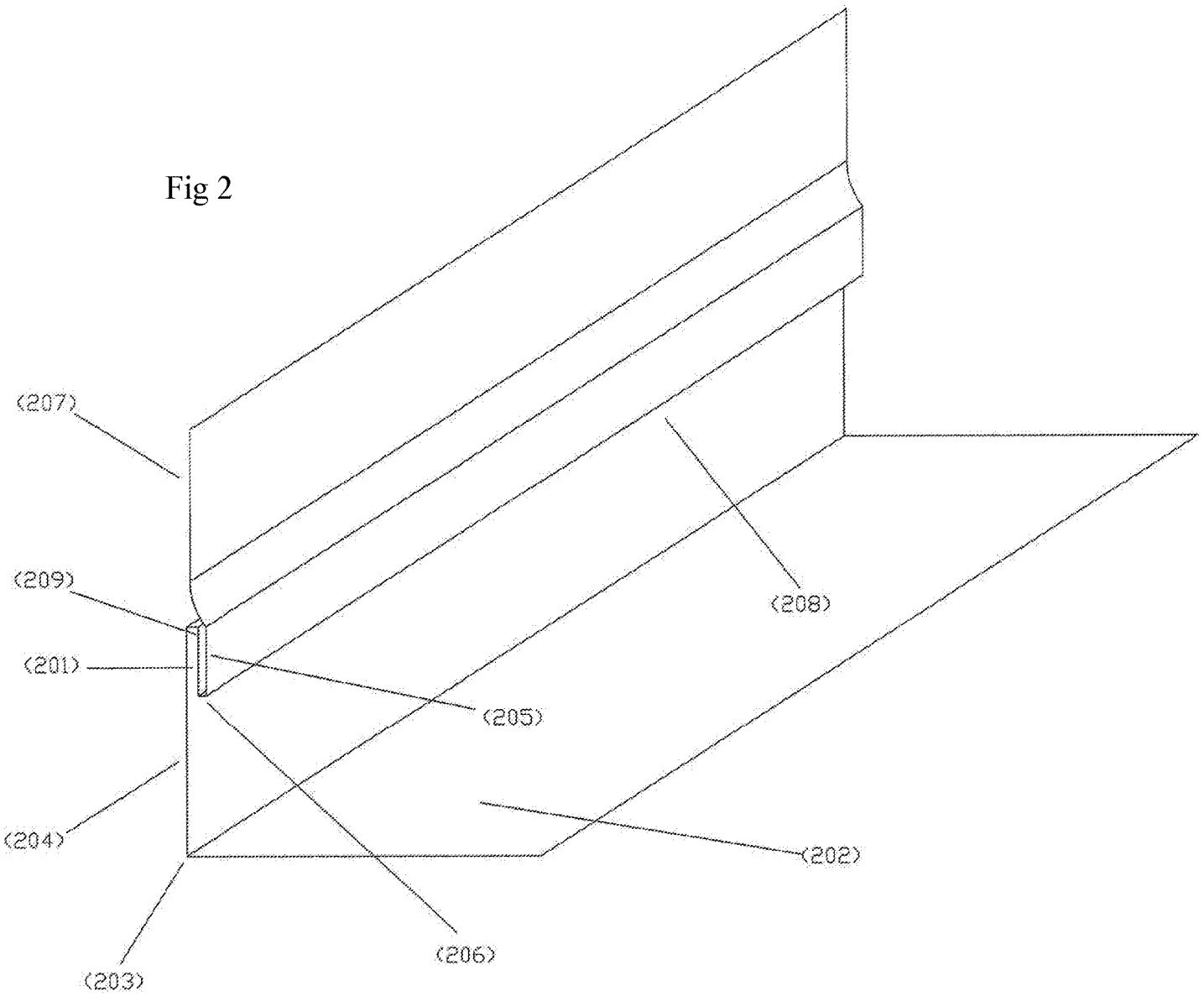
FIG. 2 is a double coverage roof wall flashing with a cavity and closed hem, in accordance with embodiments of the present invention.

The placement of the notch 1000 is very important to achieving the proper overlap. The notched section of the flashing may be the top side facing towards the ridge on sloped roof applications. As such, in FIG. 1, the material removed to provide for proper overlap on metal sections would be as follows: remove metal on the bottom of closed hem 106 and metal from the inner portion of the hinge 111 to create a notch 1000. The disclosure as depicted in FIG. 2 should have the following material removed from metal sections thereof to provide for proper overlap: remove metal from the closed hem 205 closest to the wall flashing 204 from the point 206 to the hinge 210 and along the straight line 208. While these locations are preferred, others may be used, as would be known to one of ordinary skill in the art.

In embodiments, the flashing is folded or gaped at the time of fabrication. The notch 1000 or fold, including expansion or gaping of metal sections via the use of specialty machinery, permits for the elimination of a notch 1000 and allows sections of the flashing disclosed herein to connect in a seamless manner.

Furthermore the flashing disclosed herein, in embodiments, is fabricated without the base flashing (101 and 202). Using such embodiments, the flashing may be installed onto custom fabricated or stock flashings as an additional piece, thereby providing for the future benefits of the cavity without changing the way systems are installed today.

Figure 3:
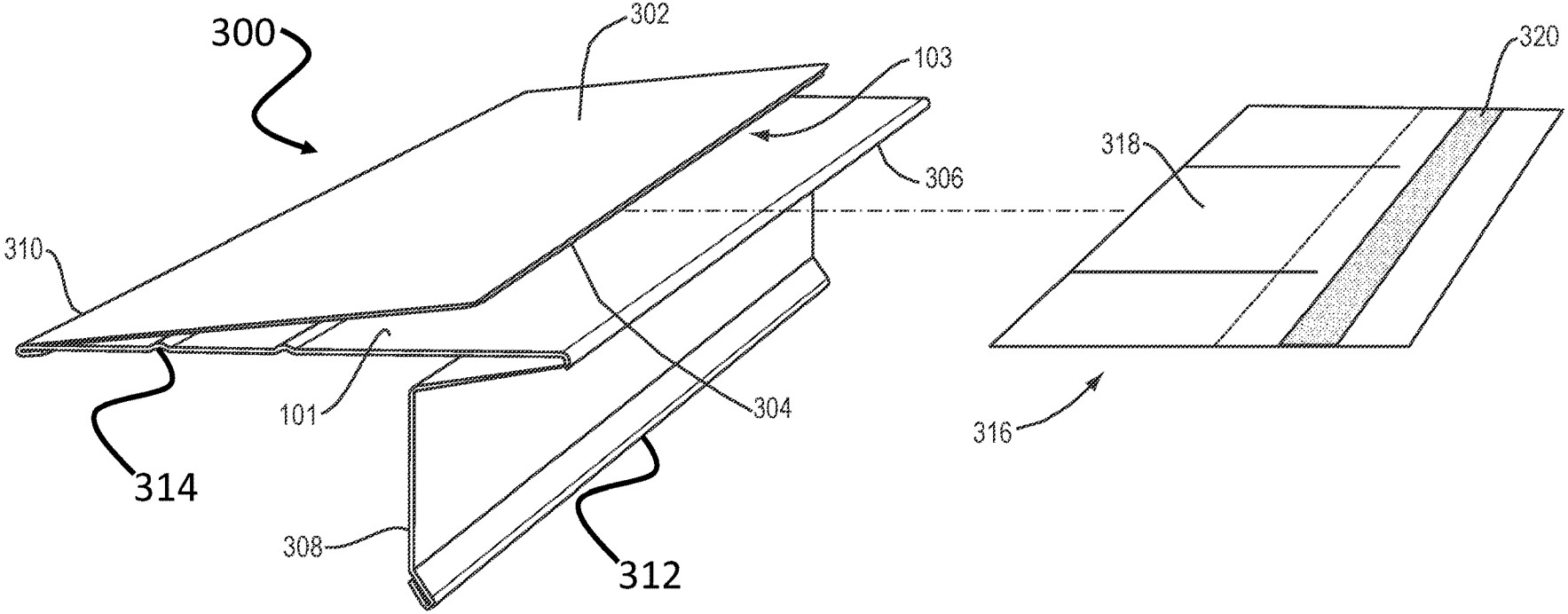
FIG. 3 is a starter shingle flashing with a cavity, in accordance with embodiments of the present invention.

Now specifically referring to FIG. 3, said flashing, which may also be referred to herein as a drip edge 302, in embodiments, is configured to be used along a rake and/or an eave of a building envelope and to partially contain a starter shingle in a cavity therein. Notably, by providing for insertion of a starter shingle in a cavity 103 formed by the intersection of an upper flap 302 and base flashing 101 that forms a topmost portion of the drip edge 300, protection against wind uplift is provided while mitigating nail blow through common to shingles when installed in cold weather, the upper flap 302 serving to spread the load of the nail over a much larger portion of the shingle than a standard roofing nail head alone would typically provide. In short, the strength of the starter shingle becomes equal to the strength of the drip edge 300 in accordance with such embodiments, improving the shingle's ability to remain fastened to the roof, especially during high wind events.

In embodiments, the drip edge 300 comprises closed hems 310, which function to increase the rigidity of portions of the drip edge 300.

In embodiments, the drip edge 300 comprises a nose 306 configured to extend off of a building envelope and/or a fascia portion 308 configured to abut a fascia adjacent the section of roof on which the drip edge 300 is mounted following installation.

In embodiments, a terminal edge of the upper flap 304 of the drip edge 300 stops short of the nose 306, allowing an adhesive mass 320 that may be disposed on the starter shingle 316 to adhere to an overlying course of shingles, in embodiments field shingles, while maintaining the benefits of the drip edge 300 configuration disclosed herein.

In embodiments, the drip edge 300 further comprises a kick 312 configured to direct rain water away from a building envelope on which the drip edge 300 is mounted, the kick 312, in embodiments, forming a lowermost portion of the drip edge 300.

Figure 4:
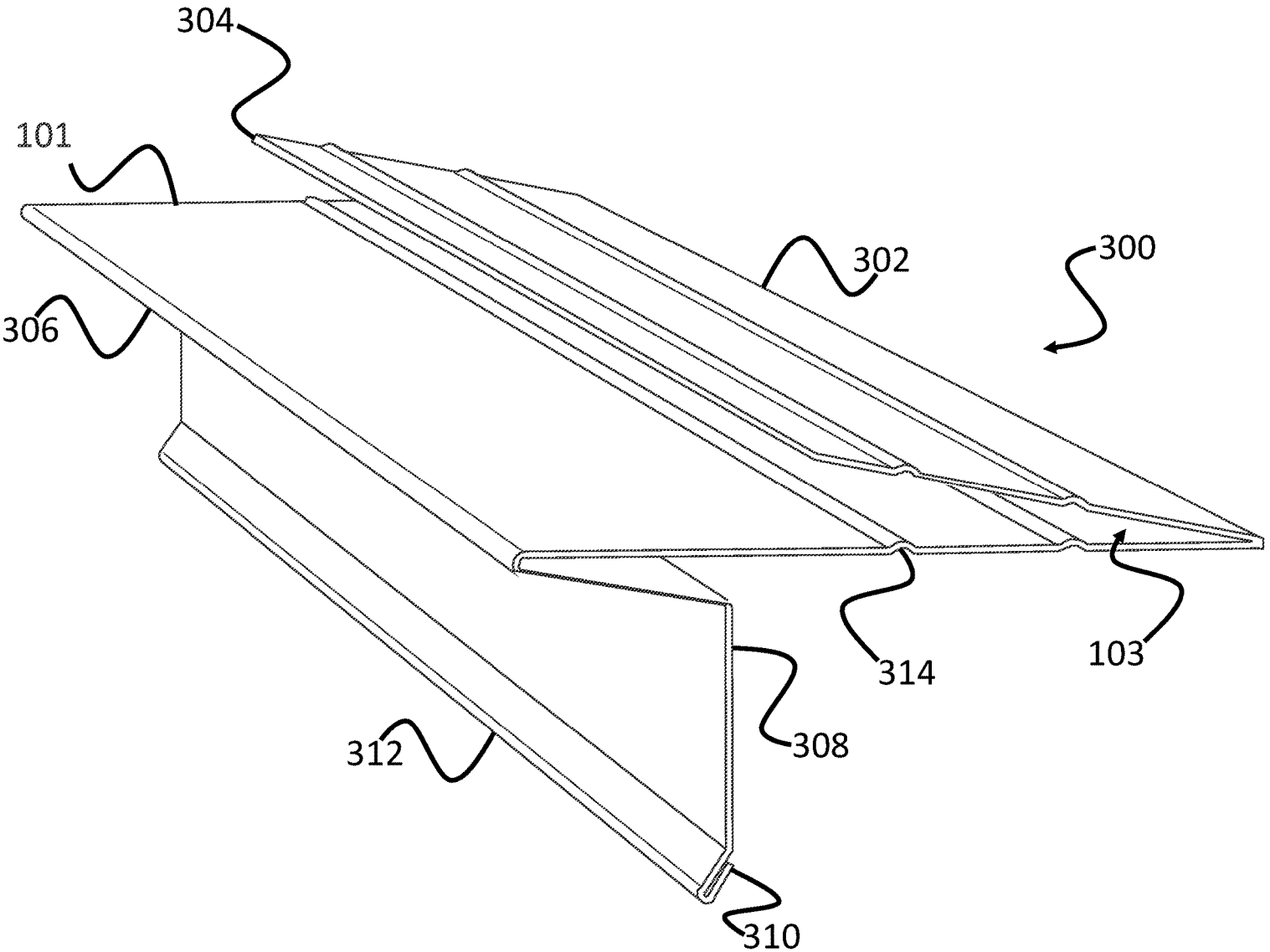
FIG. 4 is a starter shingle flashing with a cavity and also having elevated ribs, in accordance with embodiments of the present invention.

In embodiments, such as those shown in FIGS. 3 and 4, the drip edge 300 includes ribbing 314 on the upper flap 302 and/or base flashing 101, increasing the rigidity thereof. In embodiments, the ribbing is parallel to the kick 312. In embodiments, the kick 312 extends between parallel, shorter edges of the drip edge 300.

In embodiments, such as that shown in FIG. 4, ribbing 314 on the upper flap 302 and base flashing 101 is substantially aligned. In embodiments, ribbing 314 on the upper flap 302 and base flashing 101 is substantially aligned, with ribs 314 on one surface being concave and the other convex, such that the ribs 314 fit closely within one another, providing additional grip on a starter shingle 316 held within the cavity 103.

Figure 5:
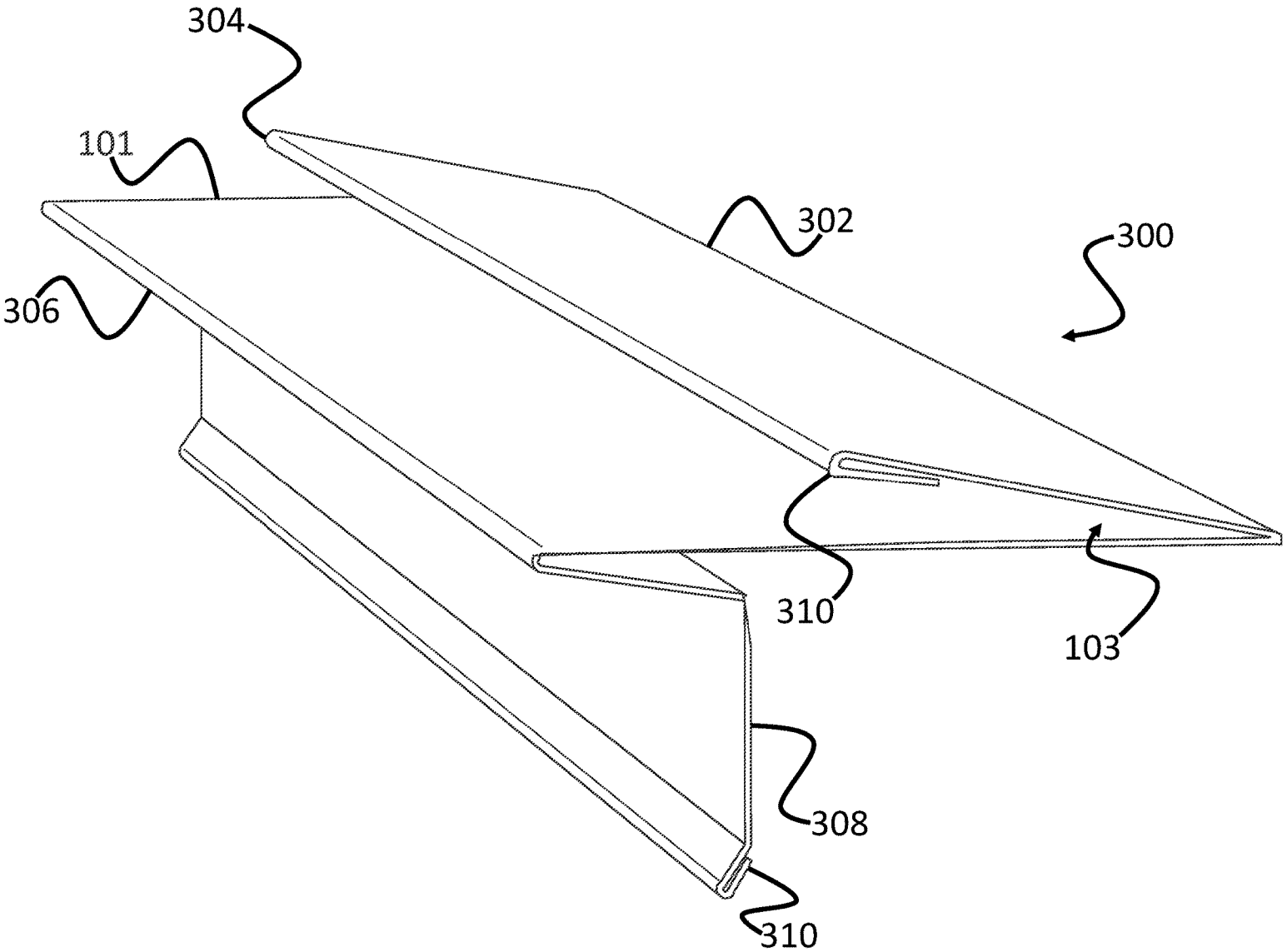
FIG. 5 is a starter shingle flashing with a cavity and also having a closed hem in an upper flap portion thereof, in accordance with embodiments of the present invention.

Now referring to FIG. 5, an embodiment of the drip edge 300 is shown in which the terminal edge of the upper flap 304 of the drip edge 300 comprises a closed hem 310, increasing the rigidity of the upper flap 302.

Figure 6:
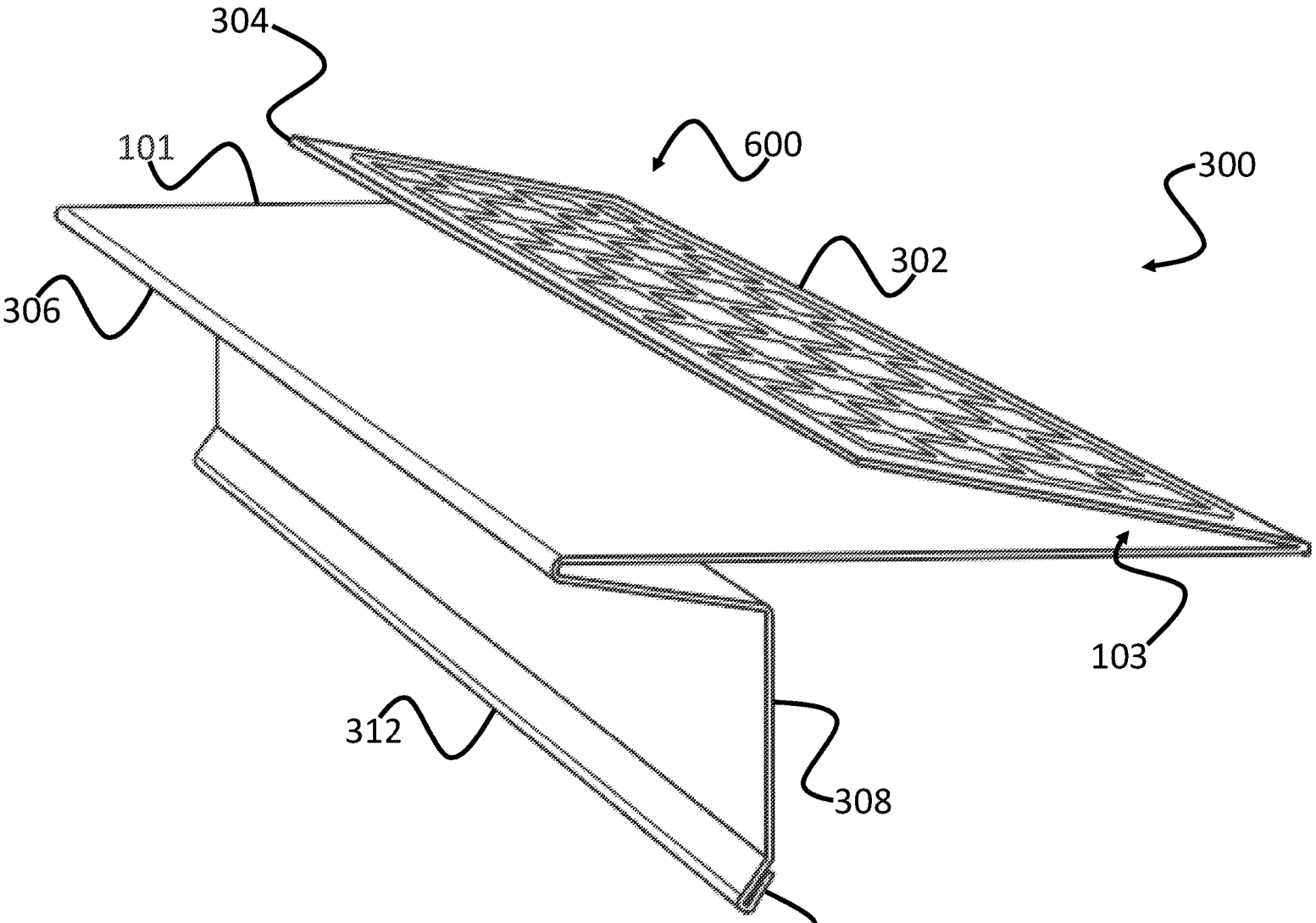
FIG. 6 is a starter shingle flashing with a cavity and also having lacerations in an upper flap thereof, in accordance with embodiments of the present invention.

Now referring to FIG. 6, an embodiment of the drip edge 300 is shown in which upper flap 302 comprises a plurality of lacerations 600, helping the upper flap 302 to retain a shingle in an overlying course.

Figure 7:
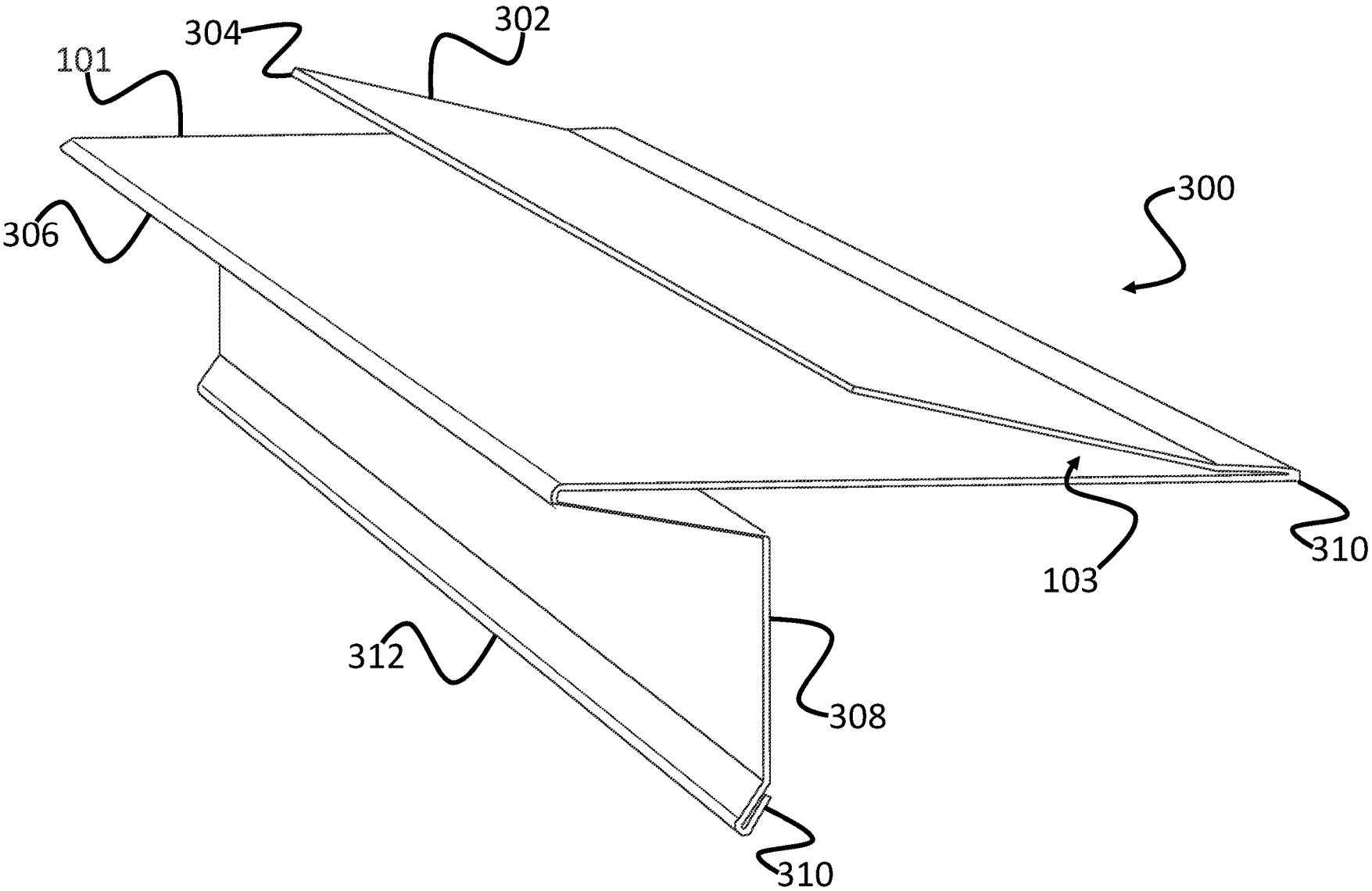
FIG. 7 is a starter shingle flashing with a cavity and also having a closed hem in an upper flap thereof, in accordance with embodiments of the present invention.

Now referring to FIG. 7, an embodiment of the drip edge 300 is shown in which upper flap 302 comprises a closed hem 310 opposite the terminal edge of the upper flap 304. This provides both increased rigidity of the upper flap 302 while also allowing the shingle overhang to be easily adjusted to accommodate a variety of starter shingles 316. The closed hem 310 of this embodiment also provides a nailing surface through which the drip edge 300 may be fastened to a roof. Furthermore, in embodiments, a notch 1000, as depicted in FIGS. 10 and 11, is incorporated into the closed hem 310 of FIG. 7.

Figure 8:
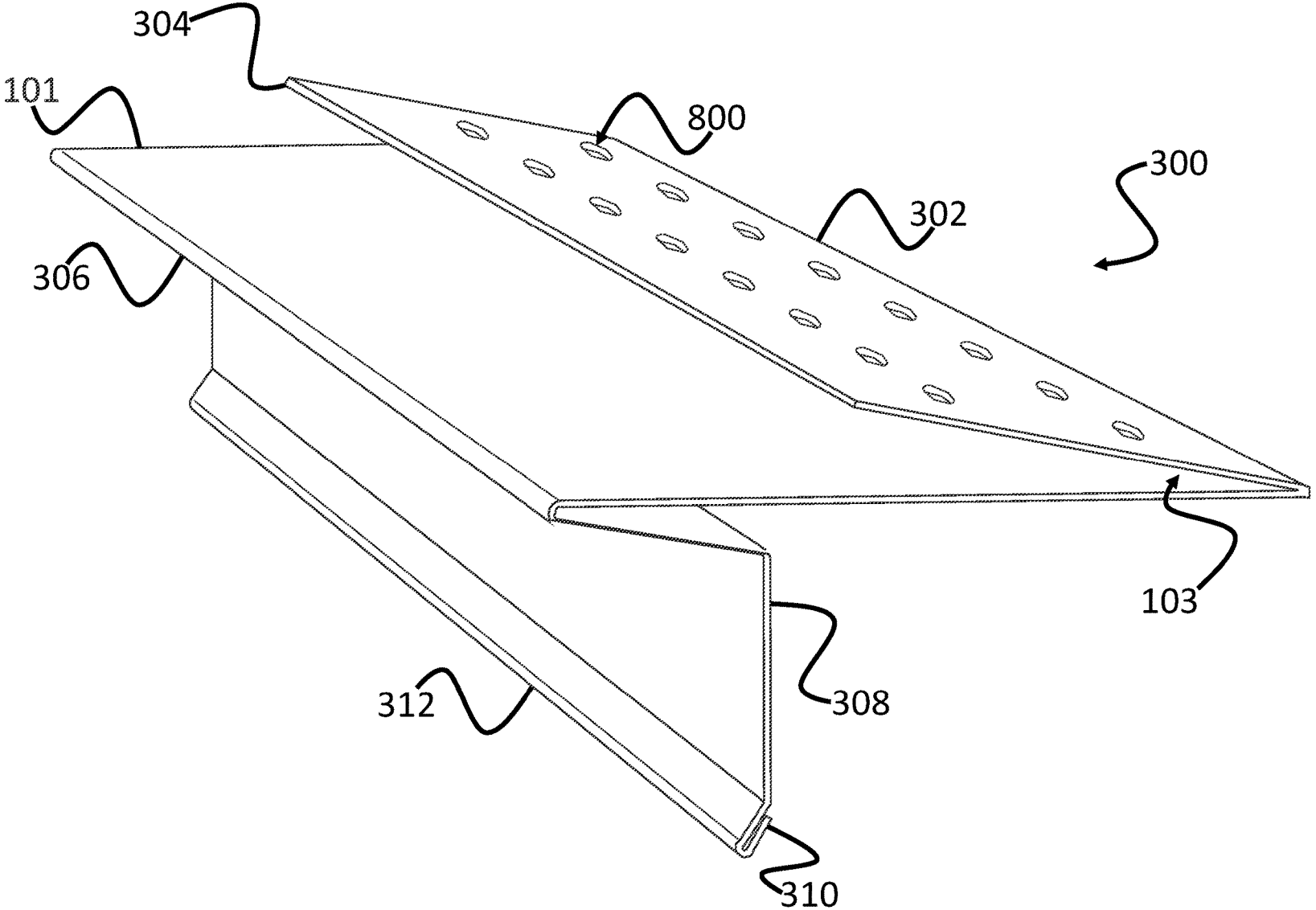
FIG. 8 is a starter shingle flashing with a cavity and also having a plurality of apertures in an upper flap thereof, in accordance with embodiments of the present invention.

Now referring to FIG. 8, an embodiment of the drip edge 300 is shown in which upper flap 302 comprises a plurality of apertures, helping the upper flap 302 to retain a shingle in an overlying course.

Figure 9:
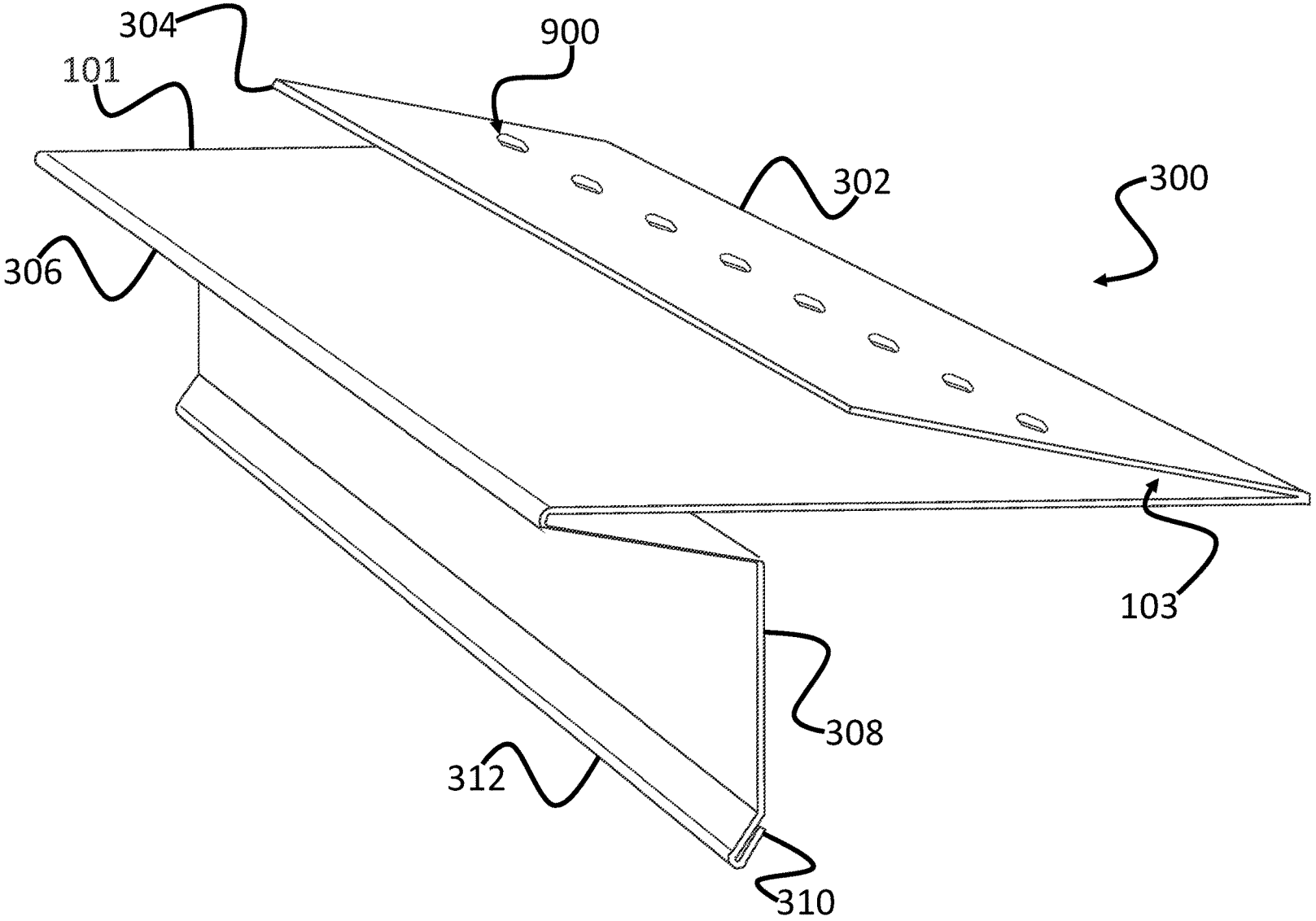
FIG. 9 is a starter shingle flashing with a cavity and also having a plurality of nail placement locations in an upper flap thereof, in accordance with embodiments of the present invention.

Now referring to FIG. 9, an embodiment of the drip edge 300 is shown in which upper flap 302 comprises a plurality of marked nailing locations 900, helping to guide an installer and ensure a strong fastening of the drip edge 300 and starter shingle 316 to a roof. In embodiments, the marked nailing locations 900 comprise apertures, perforations, dimples, marks, and similar features, as would be known to one of ordinary skill in the art.

Figure 10:
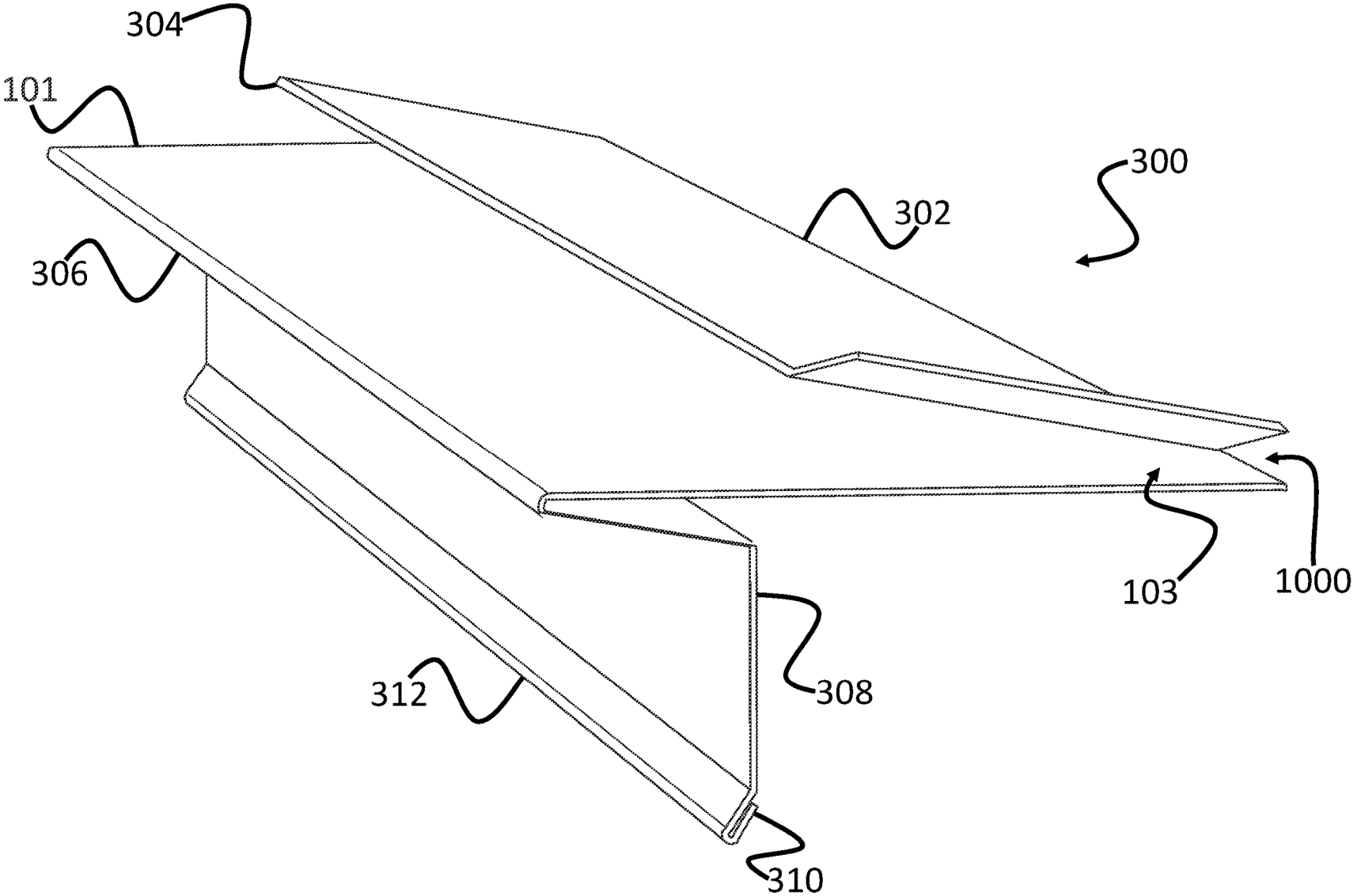
FIG. 10 is a starter shingle flashing with a cavity and also having a portion of an upper flap thereof folded, creating a notch, in accordance with embodiments of the present invention.
Figure 11:
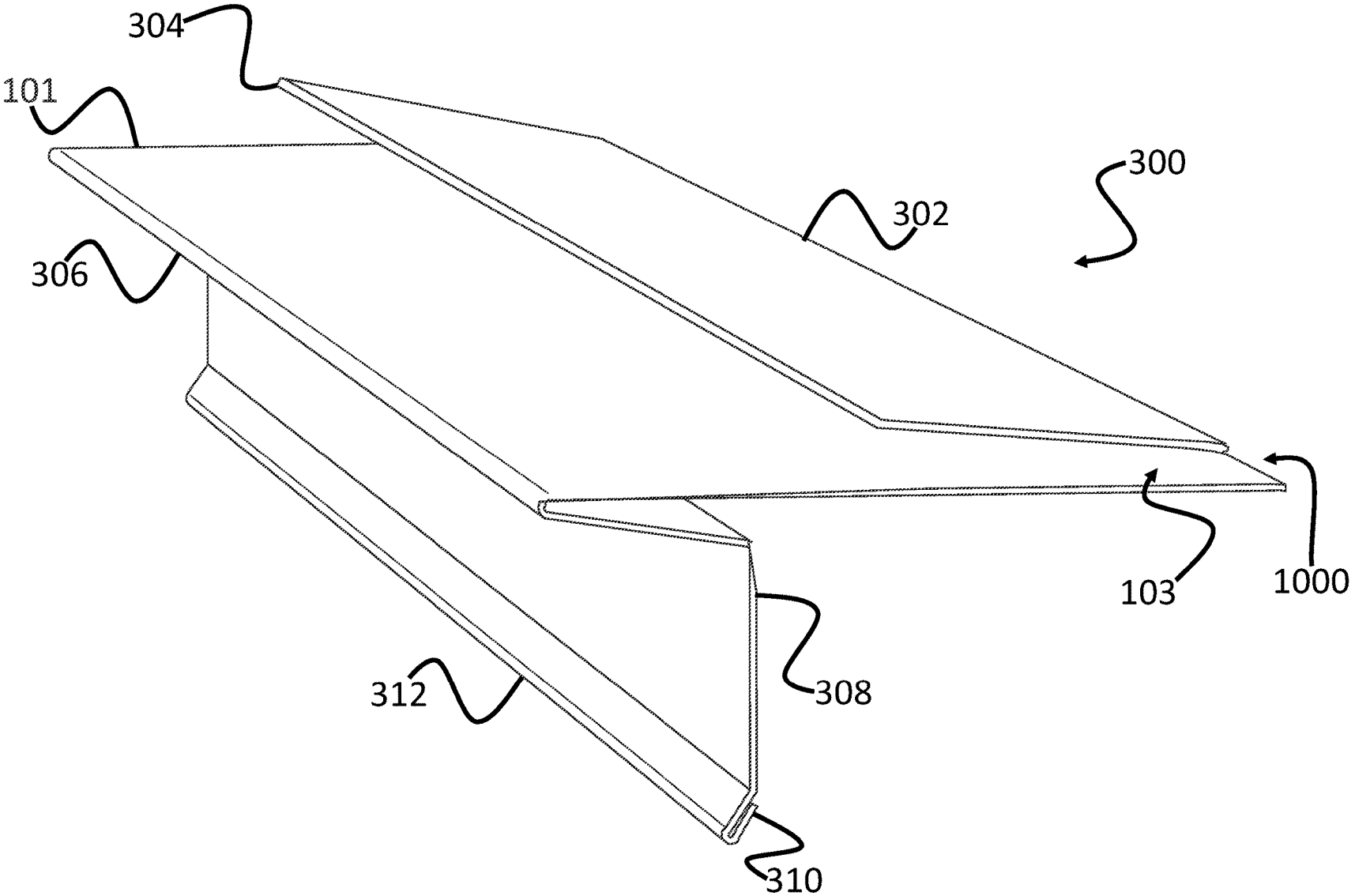
FIG. 11 is a starter shingle flashing with a cavity and also having a notch in an upper flap thereof, in accordance with embodiments of the present invention.

Now referring to FIGS. 10 and 11, embodiment of the drip edge 300 are shown in which upper flap 302 comprises a notch 1000, with FIGS. 10 and 11 showing different types of suitable notches 1000, the notches 1000 being configured to allow sections of drip edge 300 to be seamlessly mated to one another, helping to ensure water is directed off of the completed roof. These notches 1000, in embodiments, are also used to ensure a predefined drip edge 300 overlap is maintained from section to section by allowing the installer to maintain the predefined overlap merely by abutting the notch 1000 to the upper flap 302 of a subsequent drip edge 300. Furthermore, while notches 1000 are shown only in FIGS. 10 and 11, they may be used in combination with various embodiments shown herein and can be incorporated either during production of the drip edge 300 or formed by an installer on-site using hand tools.

Figure 12:
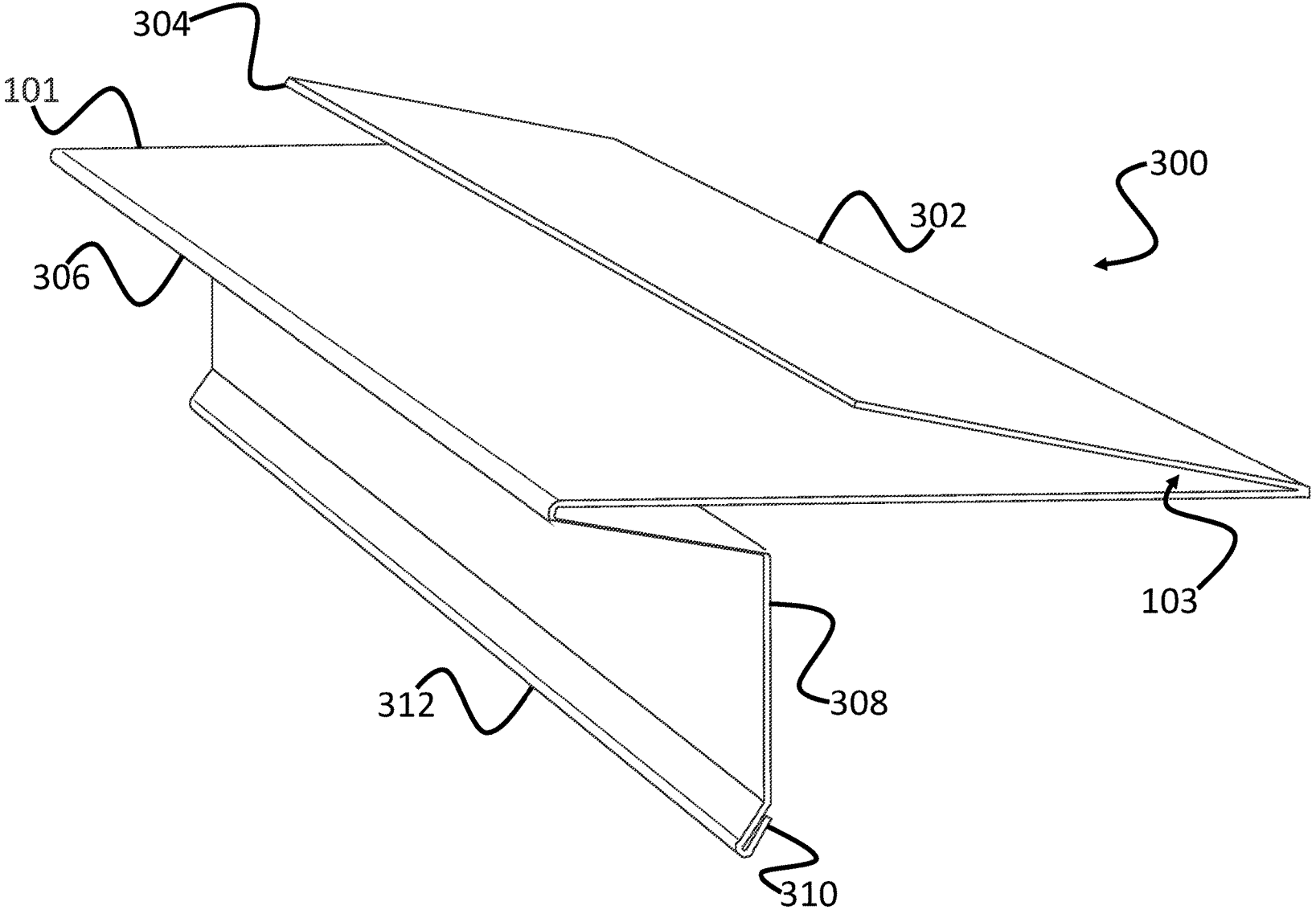
FIG. 12 is a starter shingle flashing with a cavity and nose section, in accordance with embodiments of the present disclosure.

Now referring to FIG. 12, a basic drip edge 300 without ribbing 314 or other features is shown, in accordance with embodiments of the present disclosure. In embodiments, an installer could use snips to notch the drip edge 300 of such embodiments.

Figure 13:
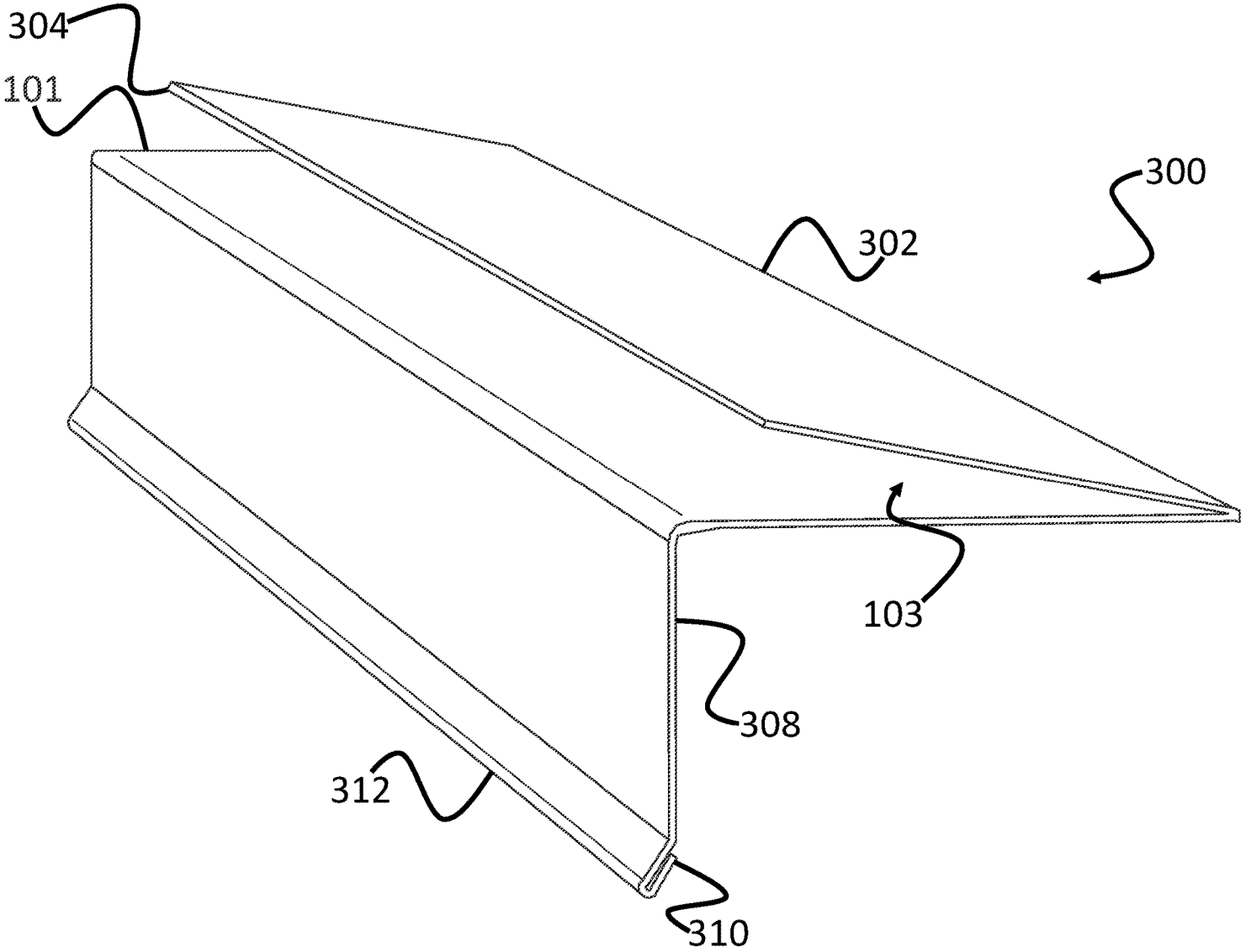
FIG. 13 is a starter shingle flashing with a cavity, in accordance with embodiments of the present disclosure.

Now referring to FIG. 13, a basic drip edge 300 without ribbing 314, a nose 306, or other features is shown, in accordance with embodiments of the present disclosure.

The flashing disclosed herein is, most preferably, fabricated using a metal break of roll former, although other methods could be used, as would be known to one of ordinary skill in the art. The source material, typically metal, may be obtained in flat sheets or in roll form and be slit to the desired width prior to fabrication.

Materials, especially metals, are offered in a variety of gauges and mils, depending on local codes and performance requirements. The dimensions of the gap and the fabricated widths can vary from site to site, depending on the roofing system being installed and site conditions discovered prior to fabrication.

A benefit of this drip edge 300 configuration is that any wind-driven moisture that tries to enter at the interface between an underside of a starter shingle 316, in embodiments a three tab starter shingle 316 having multiple tabs 318, and the base flashing 101 is returned toward the rake or eave, dependent on which section of roof the drip edge 300 is mounted, as opposed to migrating between and underneath shingles, as is common with prior art configurations.

Lastly, even another benefit of the drip edge 300 disclosed herein is that it ensures proper starter shingle 316 overhang, by design. More specifically, by inserting the starter shingle 316 into the cavity 103 formed by the upper flap 302 and base flashing 101 until it stops, a consistent overlap of the starter shingle 316 from the nose 306 of the drip edge 300 is easily obtained.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A drip edge comprising:

a flange configured to rest against a roof surface following installation of the drip edge on a perimeter of the roof surface; and a flap hingedly extending from a terminal edge of the flange, wherein the terminal edge of the flange from which the flap hingedly extends is configured to be in contact with the roof surface, adjacent the perimeter of the roof surface, following installation of the drip edge on the perimeter of the roof surface, wherein the flap is configured to extend a predefined distance towards the ridge of the roof, as measured from an edge of the roof surface on which the flange is configured to be mounted, following installation of the drip edge on the roof surface, wherein the flap is configured to be parallel to, or form an acute angle with, a portion of the flange configured to rest against a roof surface following installation of the drip edge on the perimeter of the roof surface, and wherein said flap and said flange, in combination, form a cavity that is configured to lie flat against the roof surface, face towards a ridge of the roof, and retain a shingle, following installation of the drip edge on the perimeter of the roof surface.

2. The drip edge of claim 1, the drip edge further comprising a kick portion extending downwards from a terminal edge of said flange opposite the terminal edge of the flange on which the flap extends from, the terminal edge of said flange opposite the terminal edge of the flange on which the flap extends from being configured to be adjacent the edge of the roof surface on which the flange is configured to be mounted after installation on the roof, wherein said kick portion is configured to abut a fascia or trim following installation of the flange on the building envelope.

3. The drip edge of claim 1 wherein said drip edge further comprises at least one protrusion in said flange.

4. The drip edge of claim 3 wherein said at least one protrusion in said flange comprises a stiffening feature.

5. The drip edge of claim 4 wherein said stiffening feature comprises at least one rib.

6. The drip edge of claim 4 further comprising at least one protrusion in said flap hingedly extending from a terminal edge of the flange.

7. The drip edge of claim 6 wherein each of the at least one protrusion in said flap hingedly extending from a terminal edge of the flange is parallel to each of the at least one protrusion in said flange.

8. The drip edge of claim 7 wherein a terminal edge of said flap hingedly extending from a terminal edge of the flange is configured to retain a starter shingle retained in said cavity configured to retain the starter shingle such that at least a portion of a topside thereof is unobstructed, allowing a portion thereof to adhere to a shingle in an overlying course of shingles.

9. The drip edge of claim 1 wherein said drip edge further comprises at least one protrusion or recess in said flange.

10. The drip edge of claim 1 wherein said drip edge further comprises at least one protrusion or recess in said flap hingedly extending from a terminal edge of the flange.

11. The drip edge of claim 10 further comprising at least one protrusion or recess in said flange.

12. The drip edge of claim 10 wherein at least one protrusion or recess in said flange is aligned with at least one recess or protrusion, respectively in said flap hingedly extending from a terminal edge of the flange.

13. The drip edge of claim 1 wherein a terminal edge of said flap hingedly extending from a terminal edge of the flange is configured to align with a terminal edge of said flange parallel to and opposite from the terminal edge of the flange on which the flap extends from.

14. The drip edge of claim 1 wherein a terminal edge of said flap hingedly extending from a terminal edge of the flange is configured to align with a portion of the flange short of a terminal edge of said flange parallel to and opposite from the terminal edge of the flange on which the flap extends from.

15. The drip edge of claim 1 wherein a terminal edge of said flange parallel to and opposite from the terminal edge of the flange on which the flap extends from comprises a rounded nose configured to extend off of the roof, following installation thereon.

16. The drip edge of claim 1 wherein a terminal edge of said flange parallel to and opposite from the terminal edge of the flange on which the flap extends from comprises a 90 degree corner configured to abut a facia or rake following installation on the roof.

17. The drip edge of claim 1 wherein a terminal edge of said flap hingedly extending from a terminal edge of the flange that is opposite from and parallel to the terminal edge of the flange from which said flap extends comprises a closed hem.

18. The drip edge of claim 1 wherein an upper face of said flap hingedly extending from a terminal edge of the flange in configured to be expandable by an installer.

19. The drip edge of claim 18 wherein the upper face of said flap hingedly extending from a terminal edge of the flange comprises a plurality of lacerations therein configured to allow the expansion thereof.

20. The drip edge of claim 1, comprising a closed hem at the intersection between the flange and the flap.

21. The drip edge of claim 1 wherein the flap hingedly extending from the terminal edge of the flange comprises a plurality of apertures therethrough.

22. The drip edge of claim 1 wherein a plurality of apertures are dispersed both horizontally and longitudinally across the flap hingedly extending from the terminal edge of the flange.

23. The drip edge of claim 1 wherein a plurality of apertures are dispersed longitudinally across the flap hingedly extending from the terminal edge of the flange and wherein the plurality of apertures are configured to indicate predefined nailing locations for fastening a shingle to the drip edge using nails.

24. The drip edge of claim 1 wherein the drip edge is made of a material selected from the group consisting of aluminum, steel, copper, and plastics.

25. The drip edge of claim 1 wherein an edge of the intersection of the flap with the terminal edge of the flange from which the flap extends comprises a notch configured to allow multiple drip edges to be interlocked together.

* * * * *